United States Patent [19]

Caporusso et al.

[11] Patent Number: 4,811,589

[45] Date of Patent: Mar. 14, 1989

[54] FORK MEMBER FOR PIPE-BENDING APPARATUS TO SUPPORT SPACED PIPE ABUTMENT

[76] Inventors: Alessandro Caporusso, Via Pantanelle, 21; Mario Caporusso, both of Piedimonte San Germano, Frosinone, Italy

[21] Appl. No.: 119,173

[22] Filed: Nov. 12, 1987

[30] Foreign Application Priority Data

Nov. 28, 1986 [IT] Italy ..... 36281/86[U]

[51] Int. Cl.[4] ..... B21D 9/05

[52] U.S. Cl. ..... 72/389; 72/213

[58] Field of Search ..... 72/389, 212, 213, 215, 72/381, 383

[56] References Cited

U.S. PATENT DOCUMENTS

| | | | |
|---|---|---|---|
| 3,918,286 | 11/1975 | Whitehead | 72/389 |
| 4,141,235 | 2/1979 | Ishihara | 72/389 |
| 4,638,665 | 1/1987 | Benson et al. | 72/389 |

FOREIGN PATENT DOCUMENTS

| | | | |
|---|---|---|---|
| 153622 | 4/1952 | Australia | 72/389 |
| 562088 | 2/1959 | Italy | 72/389 |
| 588352 | 2/1959 | Italy | 72/389 |
| 1034200 | 9/1979 | Italy . | |
| 1155757 | 1/1987 | Italy . | |
| 421403 | 3/1974 | U.S.S.R. | 72/389 |
| 1261731 | 10/1986 | U.S.S.R. | 72/389 |
| 642044 | 8/1950 | United Kingdom | 72/212 |

*Primary Examiner*—David Jones

*Attorney, Agent, or Firm*—Young & Thompson

[57] ABSTRACT

A fork member for the bending section of a pipe bending apparatus includes a flat base having two symmetrically disposed diverging legs. Each leg has a protruding headed pin and a set of slots extending radially from the pin symmetrically on both legs. An elongated arm is removably mountable on each leg. Each arm has two axially elongated keyhole openings and an axially extending rib. When a selected opening in the arm is hooked over a corresponding pin on the corresponding leg, and the rib on the arm is disposed in the selected slot in the leg, pipe abutment members carried by the arms will be suitably spaced and positioned.

2 Claims, 2 Drawing Sheets

6
25
24
23
22
21
20
26
27
28
6

A
25
24
23
22
21
26
20

27
28
C
25
24
20
17
16
22
26
32
33
30
31
28
29
29'
20
18
26
26
14
11
B
12

10
13
L

FORK MEMBER FOR PIPE-BENDING APPARATUS TO SUPPORT SPACED PIPE ABUTMENT

DESCRIPTION

The object of the present invention is a single integral fork member as a part of the bending section of a pipe-bending apparatus, generally of the portable manually-controlled hydraulic type, which may be connected easily to the control section through the free end of the body of the apparatus along the axis of the piston of this latter which operates the bending member—or matrix—and is provided with two arms to support the concave grooved abutment members of the pipe to be bent. According to the present invention, the novelty of such a fork member is the constitution of same as a flat base comprising: an integral component element to be connected with the free end of the main body of the apparatus in such a manner that it may rotate freely together with this latter about its longitudinal axis; a pair of pins protruding from the flat surfaces of the base and symmetrically spaced from a longitudinal plane perpendicular to that base, along the axis of the pipe-bending apparatus; a set of three slots provided on the flat surfaces of both shanks of the fork member according to radial directions which are symmetrical, that is, mirror images of each other in said two shanks when referred to said plane, each set of slots departing from the pin of its respective shank; a pair of arms as carriers of abutment members of the pipe to be bent, each arm being solidly and quickly connectible to the respective base pin according to the selected slot direction.

The object of the invention is to create, for the bending section of such a pipe-bending apparatus, a fork member which allows: a notable reduction of the pipe-bending members with respect to those which are usually necessary to bend pipes the diameters of which are comprised in a selected range considered suitable for the pipe-bending apparatus to be used; the quick and easy positioning of the pair of arms on said base along the mirror image directions defined by the corresponding slots of the two sets of slots provided on the fork member shanks; limitation of the fork section components to such fork member and the auxiliary arms to be mounted thereon, these arms being in turn used to mount thereon the pipe abutment members opposite to the bending member, or matrix, when a bending operation is to be carried out, so that the weight of the bending apparatus will be reduced and the carrying of same will be easier.

To describe and illustrate the innovating features of the present invention and better interpret the advantages arising from its practical application, reference is made to a portable manually controlled hydraulic pipe-bending apparatus, for example of the type specified in Italian patent application No. 48162 A/76, but above all to the particular type of connection between the bottom free end of the body neck of the apparatus and the fork member provided for bending pipes as described and claimed in Italian patent application No. 47546 A/78, and furthermore to the preferred, already known type of pipe abutment members adapted for rotary and translatory motion, specified in such apparatus.

To better understand the invention, an embodiment of same is described hereafter which is referred to the accompanying drawings, wherein:

FIG. 1 is a front elevation view of a fork member for the bending section of a pipe-bending apparatus in accordance with this model, which is mounted on a manually controlled hydraulic pipe-bending apparatus of the type described above, the connecting device between the neck of the apparatus and the fork member of the bending section of same allowing the free rotation of this latter about its longitudinal axis, the arms to support the pipe abutment members being shown mounted thereon along mirror image radially selected directions;

Figure 3:
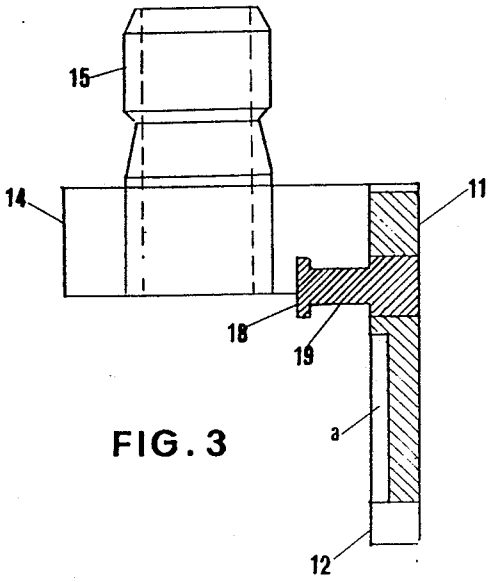
FIG. 3 shows a longitudinal section taken on line 3—3 of FIG. 2.
Figure 2:
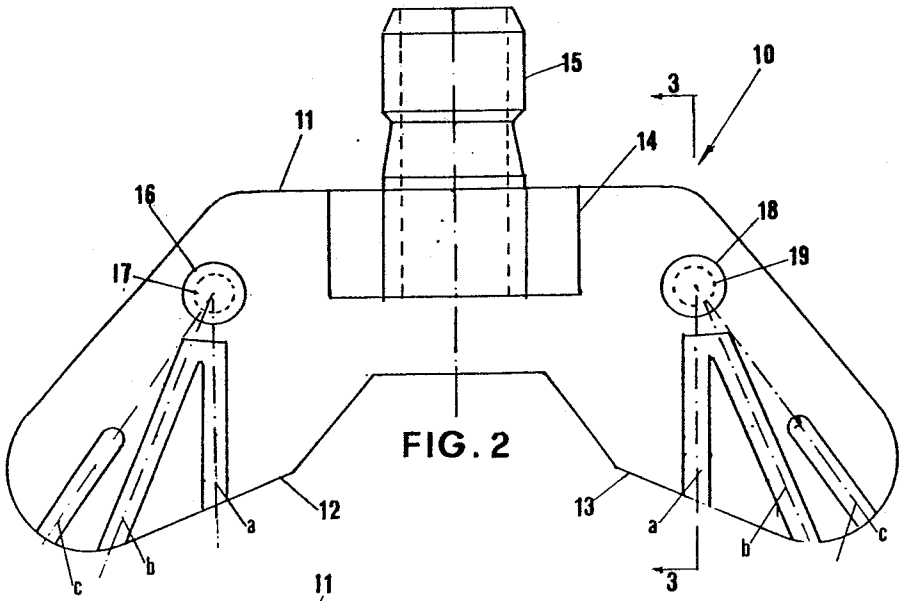
FIG. 2 is a front elevation view of a fork member of the present invention, wherein the pair of pins as well as the two sets of slots are shown to evidence the possibility of mounting thereon the arms of this bending section of the apparatus along the desired mirror image directions.
Figure 4:
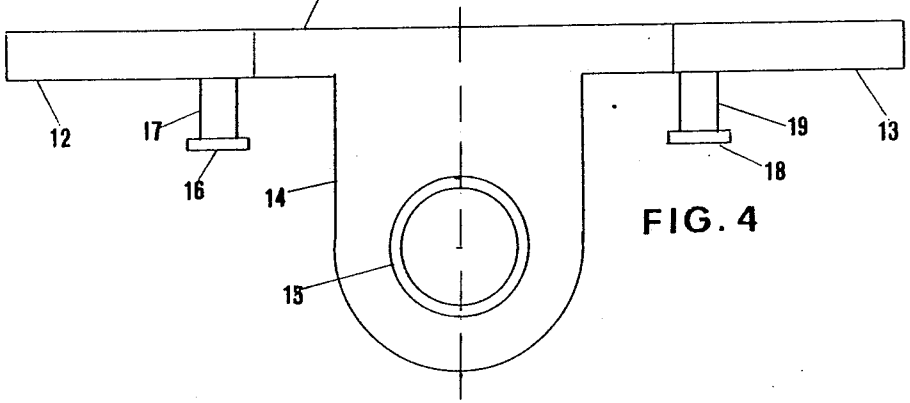
FIG. 4 shows a top view of the fork base of FIG. 2.

Turning now to the drawings, and first to FIGS. 2 to 4, it is possible to see that base 11 of this fork member comprises a flat piece with two divergent legs 12, 13 and a part 14 protruding upwards. The base, which comprises one of the innovating features of this invention, has a mirror image or bisymmetric configuration referred to a vertical plane perpendicular to the drawing sheet, along the longitudinal axis of member 15 to be connected to neck C of a pipe-bending apparatus A of the cited type (see FIG. 1). The end portion of stem B which protrudes downwards is usually used to mount thereon a bending member (not shown).

As illustrated in FIG. 2 and better evidenced in FIGS. 3 and 4, a pair of pins 17, 19 protrude from the front surface of base 11 with respective heads 16, 18 of larger diameter. These pins are positioned symmetrically when referred to that plane perpedicular to such front surface, along the axis of connecting member 15 of apparatus A. As shown, from the axis of each pin 17, 19 three slots a, b and c are provided that extend radially of pins 17, 19 bisymmetrically of the midplane described above and form the possible seat of rib 26 (see FIGS. 5, 6) protruding from arm 20 because of the like shape of slot and rib, preferably at right angles. As it will be recalled later, each arm 20 may thus be mounted on a respective fork leg and solidly connected to this latter.

Figures 1, 5, 6:
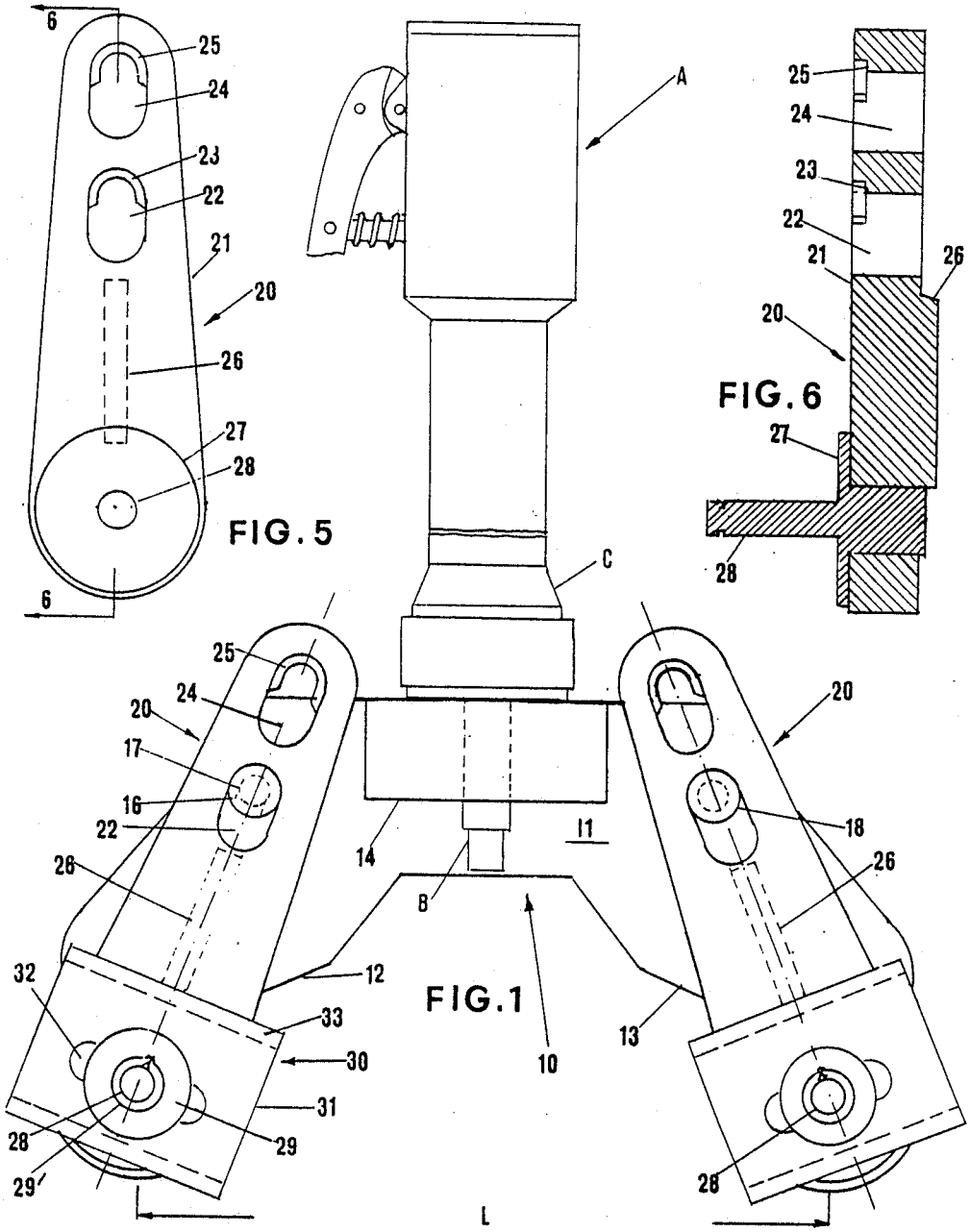
FIG. 5 is a front elevation view of one arm of the fork member according to this invention.
FIG. 6 is a sectional view taken on line 6—6 of FIG. 5.

Also thanks to the similar shape of slot and rib, the possibility of mounting quickly and easily each arm 20 on base 11 to define the position of respective abutment member 31 of the pipe to be bent, as evidenced in FIG. 1, is due to the appropriate shape and suitable position of elongated openings 22 and 24 provided in each arm 20 along the longitudinal axis of this latter. In FIGS. 5 and 6 it is possible to see that each elongated opening has a partial portion sufficiently wide to allow the free passage therethrough of the head 16, 18 of pins 17, 19 which protrude from the flat surface of base 11. As said above, the diameter of such heads is larger than the body of the pins, while a remaining arcuate portion of openings 22 and 24 has a smaller diameter corresponding to the pin body and a smaller height which forms a low step 23 (or 25). Thus the openings 22 and 24 are of keyhole configuration. Because of this particular shape and dimensions the operator may pass a pin head through the wider portion 22, 24 of the opening and place arm 20 along the selected direction (corresponding to slot a, or b, or c) and seat rib 26 therein, in order that arm 20 may be slid until the pin head overlies step 23 (or 25).

In this manner arm 20 is suitably connected to a corresponding leg 12 or 13 of fork member 10 in consequence of its solid bearing on the flat surface of this latter. An appropriate thin washer, preferably of a flat split spring type with undulations along the annular surface of same, may provide suitable friction between the concerned contact areas of flat surface of base 11 and arm 20.

In FIG. 1 each arm 20 is shown with rib 26 inserted within respective slot b of fork member leg 12 and leg 13 in accordance with this new type of fork member 10. Arms 20 are mounted on pins 17 and 19, respectively, of the base 11 by passing these latter through the opening of each arm indicated by the reference numeral 22. By mounting both arms 20 in this manner, the center distance between the pins, indicated by the character L in FIG. 1, constitutes one of the six possible center-to-center distances which may be provided between pins 28 used to mount the abutment members 30 of a pipe to be bent. As shown in this embodiment, the pipe abutment members are of the conventional rotary and translatory type.

By taking into account that: slots a, b, c are bisymmetrically provided in the two fork member legs 12, 13 of base 11 in accordance with this invention; fork member 10 allows, through these slots, the arrangement of the two arms along the directions of the respective slots a, or b, or c; each arm is provided with two elongated openings 22, 24 along the longitudinal axis of same, it will be understood that an easy and quick realization of a total number of six (3×2) center distances is possible between the pins 28,28 of the abutment members 30,30, respectively of the pipe to be bent. Consequently it will also be relatively easy to provide a number of bending radii much more favourable than through the usually suggested equipment of the prior art, also when a portable pipe-bending apparatus is used to be controlled manually through one handle by a single hand in order to carry out a desired pipe bending operation in any position, and particularly when the apparatus is provided with a rotating head as shown in FIG. 1.

Those skilled in the art may better appreciate the notable advantages deriving from the use of a fork member according to this invention, when comparisons are made with the equipment provided required by the prior art. Comparative examples are given hereafter and concern a wide range of pipe diameters when a bending operation is to be carried out on site, namely the diameter range from 4 to 22 mm.

In accordance with the prior art, at least three suitable fork members are required to have preferred center distances between the pipe abutment members and carry out satisfactory bending operations, namely:

| | range of diameters | allowed center distances |
|---|---|---|
| (1) | from 4 to 15 mm | about 105 mm |
| (2) | from 8 to 18 mm | about 165 mm |
| (3) | from 8 to 22 mm | about 200 mm |

As some pipe diameters fall in more than one of the above ranges (1), (2) and (3) relating to the approximate center distance between the pipe abutment members of a corresponding fork member, the use of that fork member which is considered more suitable to effect a good bending operation is obviously advisable.

A first comparison, limited to the number of fork members to be used by the operator to bend pipes whose total range of diameter is from 4 to 22 mm, evidences very clearly that with only a single fork member 10 in accordance with the present invention it is possible to have a number of center distances greater than with said fork members (1), (2) and (3), useful intermediate center distances being also possible to carry out satisfactory bending operations.

A second comparison concerns the necessary number of bending members to be used with the cited fork members of the prior art and referred to the diameter ranges (1), (2) and (3). According to the prior art, the following numbers of bending members are required, to carry out satisfactory bending operations:

| | |
|---|---|
| for a fork member listed in (1) | 6 bending members |
| for a fork member listed in (2) | 8 bending members |
| for a fork member listed in (3) | 11 bending members |

The equipment to bend pipes whose diameter range is from 4 to 22 mm. comprises then a total of 25 bending members. It is to be recalled what was said above in relation to some pipe diameters listed in more than one of items (1), (2) and (3) as regards the approximate center distance between the pipe abutment members of a corresponding fork member; and of course the use of that bending member which is considered more suitable to effect a good bending operation is obviously advisable. By using a fork member according to the present invention, the equipment will require a very much lower number of bending members, namely:

| | |
|---|---|
| for diameter range (1) | 6 bending members |
| for diameter range (2) | 4 bending members |
| for diameter range (3) | 2 bending members |

i.e. a total of only 12 bending members.

In FIG. 2 the slots indicated by characters a, b, c on legs 12 and 13 of the flat base 11 must be considered as the seats of arms 20 and particularly the seats of respective ribs 26. As shown in FIG. 1, arms 20 are mounted along the bisymmetric slots b of the legs and create then a center distance L between pins 28 of the pipe abutment members 30 when mounted on pins 17, 19, as shown.

The advantages deriving from the use of a single fork member 10 do not relate only to higher speed by using a lower number of bending members, but evidently also to a lower total weight of the equipment and an easier and handy transport of same by the operator, a reduction of the cost of production being thus evident.

The example selected to describe the present invention referred to the accompanying drawings, and particularly the component 15 of the novel fork member 10 to be connected to the free end C of the neck of a pipe-bending apparatus of the type indicated by reference character A, does not constitute by itself a limitation. It is then possible and feasible to provide a connection not only to a hydraulic or pneumatic pipe-bending apparatus of the types described, but also to pipe-bending apparatus of a different type, the control of which is electro-hydraulic or exclusively mechanical.

We claim:

1. A fork member for the bending section of a pipe-bending apparatus, comprising a substantially flat base having a member adapted to be connected to a pipe-bending apparatus, said base having a pair of legs thereon and a pin protruding from the base adjacent each leg, each leg having a plurality of slots therein extending in different radial directions from the associated said pin, the slots and pins one one said leg being symmetrical to the slots and pins on the other said leg on opposite sides of an imaginary plane passing through said connecting member, and an elongated arm adapted to be detachably connected to each said leg, each arm having a plurality of openings therethrough elongated in the lengthwise direction of the elongated arm, each said opening being adapted to receive the associated said pin therein, and a rib extending lengthwise of each said leg and adapted to be selectively positioned in a selected one of said slots when the associated said pin is disposed in one of said elongated openings, each said pin being headed and each said opening being of key-hole configuration to receive the head of the associated pin in one position of the arm and to prevent exit of the pin in another position of the associated arm when the rib is disposed in a selected slot.

2. A fork member as claimed in claim 1, in which said slots extend through the outer edges of their respective legs.

* * * * *